US007148770B2

(12) United States Patent
Toncich

(10) Patent No.: US 7,148,770 B2
(45) Date of Patent: Dec. 12, 2006

(54) ELECTRICALLY TUNABLE BANDPASS FILTERS

(75) Inventor: Stanley Slavko Toncich, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 11/245,639

(22) Filed: Oct. 6, 2005

(65) Prior Publication Data

US 2006/0061438 A1 Mar. 23, 2006

Related U.S. Application Data

(62) Division of application No. 10/260,080, filed on Sep. 27, 2002, now abandoned.

(60) Provisional application No. 60/413,009, filed on Sep. 24, 2002, provisional application No. 60/325,701, filed on Sep. 27, 2001.

(51) Int. Cl.
*H01P 1/203* (2006.01)

(52) U.S. Cl. ..... 333/205; 333/235

(58) Field of Classification Search ..... 333/207, 333/205, 202, 222, 204, 219, 235, 223, 995
See application file for complete search history.

(56) References Cited

U.S. PATENT DOCUMENTS 5,908,811 A * 6/1999 Das ..... 505/210
5,965,494 A * 10/1999 Terashima et al. ..... 505/210

* cited by examiner

*Primary Examiner*—Stephen E. Jones
(74) *Attorney, Agent, or Firm*—Philip Wadsworth; Charles D. Brown; Donald C. Kordich

(57) ABSTRACT

A tunable bandpass filter includes at least one resonator having a reactance with a resonant frequency, a ferroelectric film having a dielectric constant with a value that changes with an applied electric field, and an electric field generating device for generating relatively constant electric fields of different strengths. The ferroelectric film is electrically coupled to the resonator so that the reactance of the resonator and therefore the resonant frequency of the resonator and the passband of the filter depends on the dielectric constant of the ferroelectric film. The electric field generating device is constructed and arranged to generate relatively constant electric fields within the ferroelectric film, thereby making the resonant frequency of the resonator and the passband of the filter a function of the strength of the relatively constant electric field.

23 Claims, 10 Drawing Sheets

| DESIGN | BENEFIT | MAIN ISSUES |
|---|---|---|
| 1) PACKAGED OVERLAY CAPACITORS. | TUNABLE FILTERS, 400 MHz, UP:<br>- STRIPLINE<br>- MICROSTRIP<br>VCO's.<br>LUMPED ELEMENT MATCHING NETWORKS. | OPTIMIZE F-E TUNING RANGE.<br>SELECT DESIRED PACKAGE(S). |
| 2) PLANAR FILTERS; MATCHING STRUCTURES | BASIC TUNABLE FILTERS; HP, LP, BP.<br>DISTRIBUTED MATCHING NETWORKS.<br>TEMP COMPENSATION. | BIAS TECHNIQUES.<br>OPTIMIZE TUNING RANGE.<br>MAINTAIN LOW LOSS. |
| 3) TUNABLE STRIPLINE; COAXIAL BPF | LOW LOSS FILTERS DUPLEXERS.<br>AREA ~ 90 $mm^2$ PCS DUPLEXER.<br>$I.L._0$ ~ 2.5 - 2.8 dB.<br>400 MHz AND UP.<br>TUNING RANGE: ~ 40% | SELECTIVE FILM DEPOSITION.<br>FABRICATION OF RESONATORS.<br>ELECTRODE DESIGN.<br>TUNING RANGE. |
| 4) DLWG FILTER | MINIMUM LOSS FILTERS/DUPLEXERS.<br>AREA ~ 400 $mm^2$ FOR PCS DUPLEXER.<br>$I.L._0$ ~ 1.6 dB.<br>1.7 GHz AND UP.<br>TUNING RANGE: ~4% - 28% | THICK FILM DEPOSITION.<br>TUNING RANGE.<br>ELECTRODE DESIGN. |
| 5) DLWG BULK F-E FILTER | MINIMUM SIZE FILTERS/DUPLEXERS.<br>AREA ~ 40 $mm^2$ PCS DUPLEXER.<br>$I.L._0$ ~ 3.8 dB, PCS.<br>1.7 GHz AND UP.<br>TUNING RANGE: ~ 40% | DEVELOP BULK THICK F-E FILM.<br>DK ~ 100; TAN ($\delta$) <~ 0.001.<br>ELECTRODE DESIGN.<br>TUNING RANGE. |

FIG. 10

ELECTRICALLY TUNABLE BANDPASS FILTERS

RELATED APPLICATIONS

The present application is a divisional of co-pending U.S. application Ser. No. 10/260,080, filed Sep. 27, 2002, now abandoned entitled "ELECTRICALLY TUNABLE BANDPASS FILTER," which claims the benefit of provisional U.S. application Ser. No. 60/325,701, entitled "ELECTRICALLY TUNABLE BANDPASS FILTERS," filed Sep. 27, 2001, and provisional U.S. application Ser. No. 60/413,009, entitled ELECTRONICALLY TUNABLE FILTERS/PASSIVES PROPOSAL, filed Sep. 24, 2002, all which are incorporated herein by reference in their entirety for all purposes.

BACKGROUND

Field

This invention relates generally to electronic filters. More specifically, this invention is directed to electrically tunable bandpass filters.

Due to increasingly crowded frequency allocations, modern wireless communication devices require increasingly stringent filtering specifications. This is particularly true for devices that operate in multiple modes and/or over multiple frequency bands. Devices now popularly in use employ fixed tuned bandpass filters (BPF) which have design tradeoffs. The design goals of low passband insertion loss (IL) and high close-in rejection conflict. Portions of the filter transfer function representing the edges of the passband have a finite slope (the passband cutoff is gradual rather than an ideal perfectly abrupt transition from 'pass' to 'no-pass'). The more sharp the cut off required, the higher the order of the filter must be. Higher order filters are more bulky and have a greater IL than lower order filters and may require extensive turning to meet specifications. To meet the out-of-band rejection specifications, typical filter designs require a transmission zero, requiring a filter vendor to tune each filter during its manufacture. Multiple filters are typically required for multi-band, multi-mode operation. In spite of this, often filter specifications are not met, resulting in accepting non-compliant parts with increased IL or inadequate rejection, or using split band designs, which require extra switches and have greater IL.

Unlike a fixed tuned BPF, a tunable filter can be dynamically tuned to different frequency ranges within a specific band, and if sufficiently tunable, different frequency ranges within multiple bands. Tunable filters have several advantages over non-tunable filters. For example, tunable filters need not have a broad passband if the passband is dynamically adjustable. A narrow transfer function with high close-in rejection can be implemented with a lower order filter than can a wide transfer function with similar close-in rejection. Therefore, unlike a fixed tuned BPF, a tunable filter can be of a lower order and still meet desired rejection specifications. Lower order tunable filters are smaller in size, have a lower profile, lower IL, and can be built using lower precision components using a simpler fabrication processes, which in turn lowers cost. In addition, one filter topology can be optimized to cover multiple bands if the tuning range is wide enough. Thus multiple filter designs are no longer needed. Also, split-band designs along with the associated switches become unnecessary.

FIG. 1 shows a typical implementation of a top coupled BPF 100. One or more resonators 106 are coupled to an input 102 and an output 104 via capacitors 108. Other realizations are also possible. The resonators are constructed and arranged so as to have a reactance that has at least one resonant frequency. At frequencies below 200–300 MHz the resonators can be constructed from discrete components (i.e. separate capacitors and inductors). Tuning involves changing the resonant frequency of the reactance by changing the values of the discrete components. At higher frequencies a more distributed layout is required because the inherent reactances of all circuit components become more significant at higher frequencies. At higher frequencies, resonators utilizing a monoblock design are commonly used.

A high frequency resonator is essentially a transmission medium with impedance discontinuities at both of its ends. Reflections at these discontinuities causes energy to build up within the resonator, a fraction of which is released during each cycle. A quality factor, Q, is defined as the ratio of the energy stored within the resonator to that dissipated during one cycle. Due to boundary conditions that must be obeyed by the electric and magnetic fields, only signals with wavelengths that divide the length of the resonator by certain discrete multiples will be maximally reflected and constructively interfere. These correspond to the resonant frequencies. Typically, the resonator is made sufficiently short such that only one resonant frequency exists within the frequency range to be filtered. Signals at other frequencies are increasingly transmitted to ground as their frequency difference from the resonance frequency increases, resulting in significant signal attenuation outside the passband.

The wavelength at a particular frequency within a particular transmission medium is a function of the reactance of that medium. The resonant frequency is changed by changing the length of the resonator as measured with respect to the wavelength of the signal such that the constructive interference underlying resonance occurs at the new resonance frequency. Electrical tuning can be accomplished either by changing the functional dependence of the local wavelength on the frequency or by changing the electrical length of the resonator.

The wavelength dependence on frequency within a transmission medium is a function of the reactance of the medium. This functional dependence of the wavelength is varied in YIG (Yttrium-Iron Garnet) resonators with the application of a variable magnetic field. But such resonators are expensive, require bulky magnetic field generating coils, and are unsuited for the low power, low profile, low cost requirements of mobile communication systems.

Another approach utilizes a bulk, single crystal ferroelectric (f-e) waveguide as a resonator, where an applied voltage across the body of the crystal is used to generate an electric field within the waveguide, thereby changing the dielectric constant of the crystal and hence its resonant frequency (see U.S. Pat. No. 5,617,104). However, the loss tangent of known f-e materials are poor compared to typical microwave ceramics. This means that the reactance of the material contains a non-negligible resistive component (i.e. an imaginary component to the dielectric constant), resulting in significant power loss via resistive heating of the material. As a result usage of bulk ferroelectric materials for resonators at GHz and sub-GHz frequencies are currently impractical for many applications. This does not preclude the use of ferroelectric films, but heretofore no prior art has disclosed or suggested the adaptation of such films to provide electrical tuning of electronic filters.

Further, bulk f-e resonators may require the application of rather high control voltages considering the relatively large geometries involved. As previously mentioned, electrical tuning can also be accomplished by changing the electrical length of the resonator. This is accomplished in the prior art via the use of varicaps in which one or more varactor diode is coupled to one end of the resonator. This arrangement electrically extends that end of the resonator because the capacitance of the varactor prevents that end from being either totally closed or totally open. Varactors provide a variable capacitance as a function of an applied dc voltage, and therefore changes the length of the resonator in response to changes in the voltage. But they are noisy, temperature dependent and have low Q's at UHF and above. They are also limited as to how they can be employed in a filter. They are too lossy to be put in parallel with a resonator and difficult to implement within a distributed design. In addition their capacitive values are relatively low and not very consistent from lot-to-lot.

SUMMARY

The invention is a tunable bandpass filter comprising: at least one resonator having a reactance with a resonant frequency, a ferroelectric f-e film having a dielectric constant with a value that changes with an applied electric field, and an electric field generating device for generating relatively constant electric fields of different strengths. The ferroelectric film is electrically coupled to the resonator so that the reactance of the resonator and therefore the resonant frequency of the resonator and the passband of the filter depends on the dielectric constant of the ferroelectric film. The electric field generating device is constructed and arranged to generate relatively constant electric fields within the ferroelectric film, thereby making the resonant frequency of the resonator and the passband of the filter a function of the strength of the relatively constant electric field.

BRIEF DESCRIPTION OF THE DRAWINGS

FIG. 10 is a table generally illustrating some of the design options, benefits and issues associated with a variety of f-e device designs.

DETAILED DESCRIPTION

The relative permittivity, □r, which determines the dielectric constant of a dielectric may be varied in f-e materials under the application of a slowly varying ("near DC") electric field (E-field). And although the loss tangent of bulk f-e dielectrics is significant, that of applicable f-e thin or thick films fabricated on a wide range of microwave ceramics may be much better, approximating that of some commonly used microwave ceramics. Therefore, rather than use a varactor or bulk f-e dielectrics for electrical tuning, thin f-e films may be used to modify the local capacitance of the transmission medium and thereby provide an adjustable reactance that changes the resonant frequency of the resonator. When properly designed and fabricated, these f-e capacitors may provide a higher capacitance and Q than varactors at frequencies above 1 GHz. They are available as thin or thick films and are ideal for tuning distributed or lumped element resonators. Their electrical properties from lot-to-lot are also more consistent than that of varactors.

Thin/thick f-e films are widely used in high temperature superconductivity work, and there are several hundred of such known materials. Film thicknesses on the order of 0.1 □m to 1 mm are typical. Barium strontium titanate, BaxSr(1−x)TiO3 (BSTO) is the most popular for room temperature operation where x is preferably between 0.3 and 0.7. Their tuning speed is about 0.3–1.0 □s for an applied constant E-field, so they are not modulated by a rf signals. An applied dc voltage Vdc is generally used to create the E-field. It is not uncommon to have films with □□r/□Vdc>3.

Figure 2:
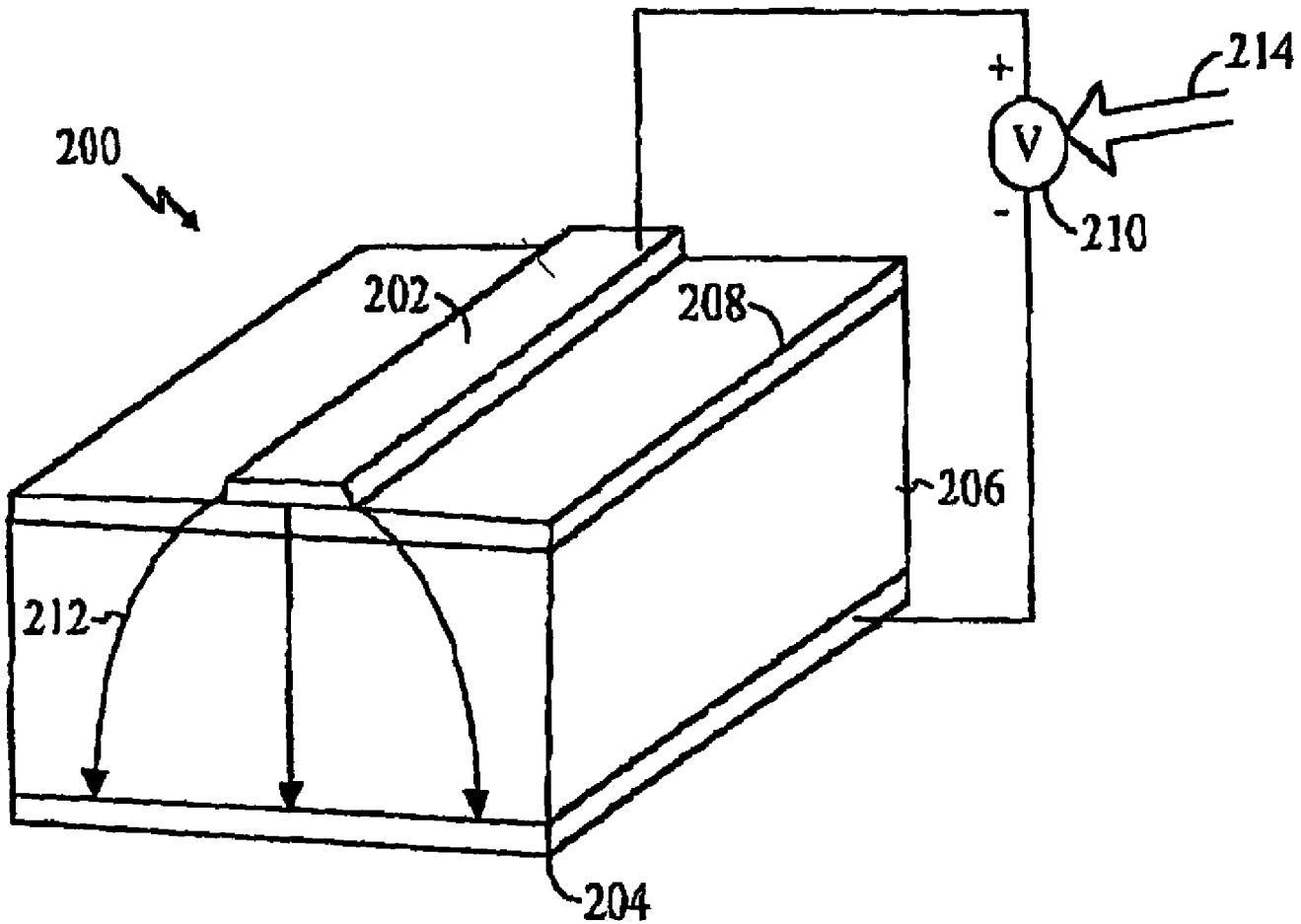
FIG. 2 is a diagram of a microstrip resonator utilizing the f-e film.

FIG. 2 is an example of a microstrip resonator 200 comprised of a microstrip filament layer 202, a ground plane 204, and a dielectric substrate 206. A f-e film layer 208 is positioned between the microstrip filament layer and the dielectric substrate. The wavelength of a propagated signal is a function of the dielectric constant of the transmission medium of the resonator and is therefore a function of the relative permittivity of the f-e film 208. A voltage applied by a dc voltage source 210 positively biases the microstrip filament 202 with respect to the ground plane 204, and creates an electric field (E-field) 212 across the f-e film that changes □r of the film and therefore the resonant frequency of the resonator. The voltage is controlled by external control signal 214.

Figure 3:
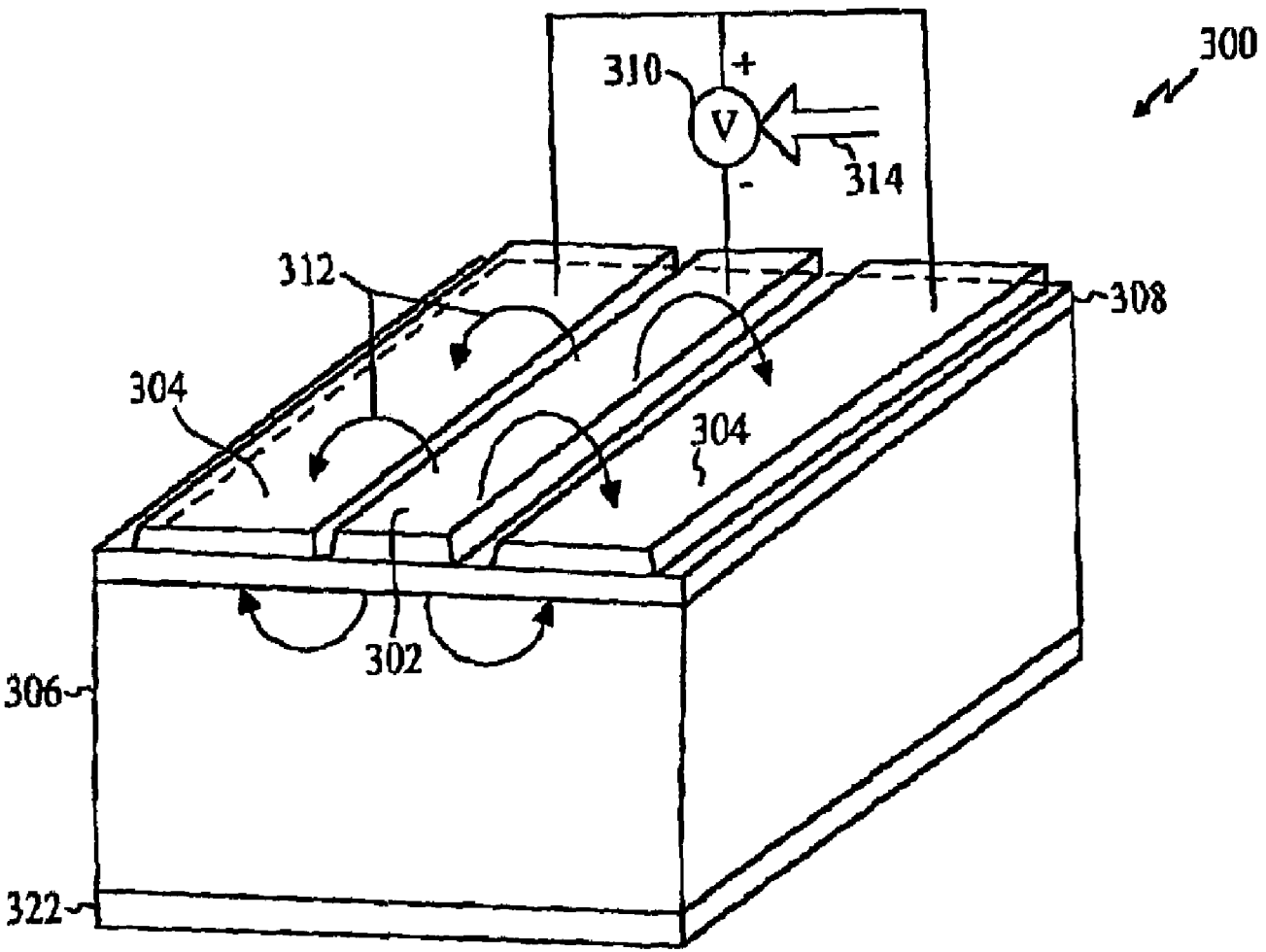
FIG. 3 is a diagram of a first example of a stripline resonator utilizing the f-e film.

FIG. 3 is a first example of a coplanar waveguide 300 comprised of a central conductor 302, two grounded outer conductors 304, a ground plane 322, and a dielectric substrate 306. An f-e film layer 308 is positioned between the stripline conductors 302 and 304, and the dielectric substrate. A voltage applied by the dc voltage source 310 positively biases the central conductor with respect to the two outer conductors and creates an electric field (E-field) 312 across the f-e film, but in this case the choice of bias arrangement is better than that of FIG. 2 because the E-field 312 is more concentrated within the f-e film and is therefore greater for the same voltage and substrate thickness. The voltage is controlled by external control signal 314.

Figure 4:
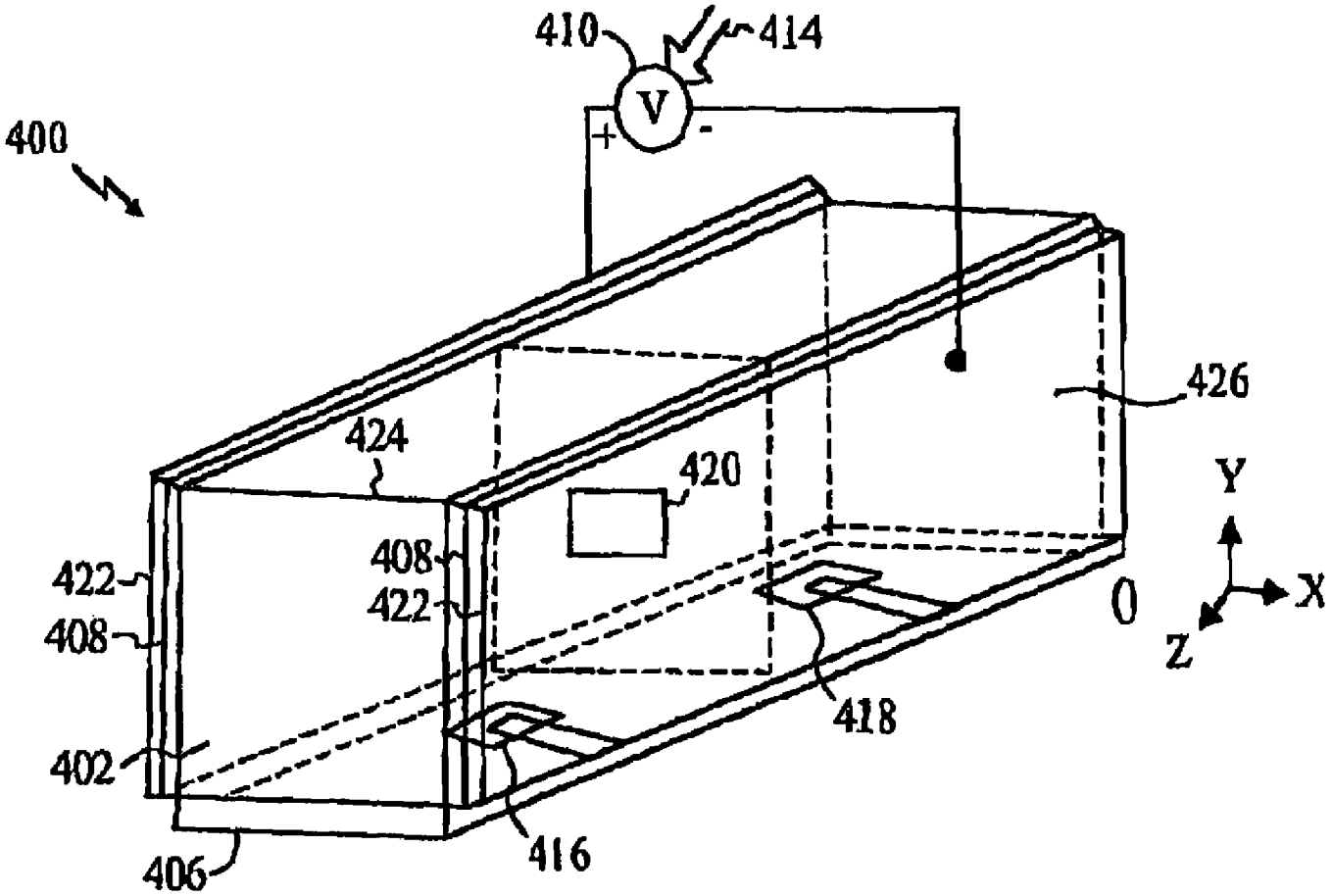
FIG. 4 is a diagram of a dielectric loaded waveguide resonator utilizing the f-e film.

FIG. 4 is an example of a dielectric loaded waveguide (DLWG) resonator filter 400. An input signal introduced via input port 416 resonates at the resonant frequency within a first half of the waveguide 424 and is coupled via 2nd order aperture 420 to a second half of the waveguide 426, which having the same resonant frequency, combine to form a second order filter. An output signal is taken via output port 418. The body of the filter, formed on substrate 406, is comprised of a high □r dielectric 402. An f-e film 408, shown mounted on the surfaces parallel to the x-y plane at the aperture, is overlaid by conducting planes 422. A voltage applied between the two conducting planes 422 generates an E-field within the f-e film 408 that changes its reactance, resulting in a change of the resonant frequency within the waveguide. The voltage applied by dc voltage source 410 is controlled by control signal 414. The f-e film 408 and conducting planes 422 could also be mounted on the surfaces parallel to the x-y plane. With no external load, a DLWG resonator can provide a Q of about 1000 within the PCS band (i.e. around 2 GHz) with an I.L. of about 1.6 dB at a 3 dB bandwidth of 10 MHz.

Figure 5:
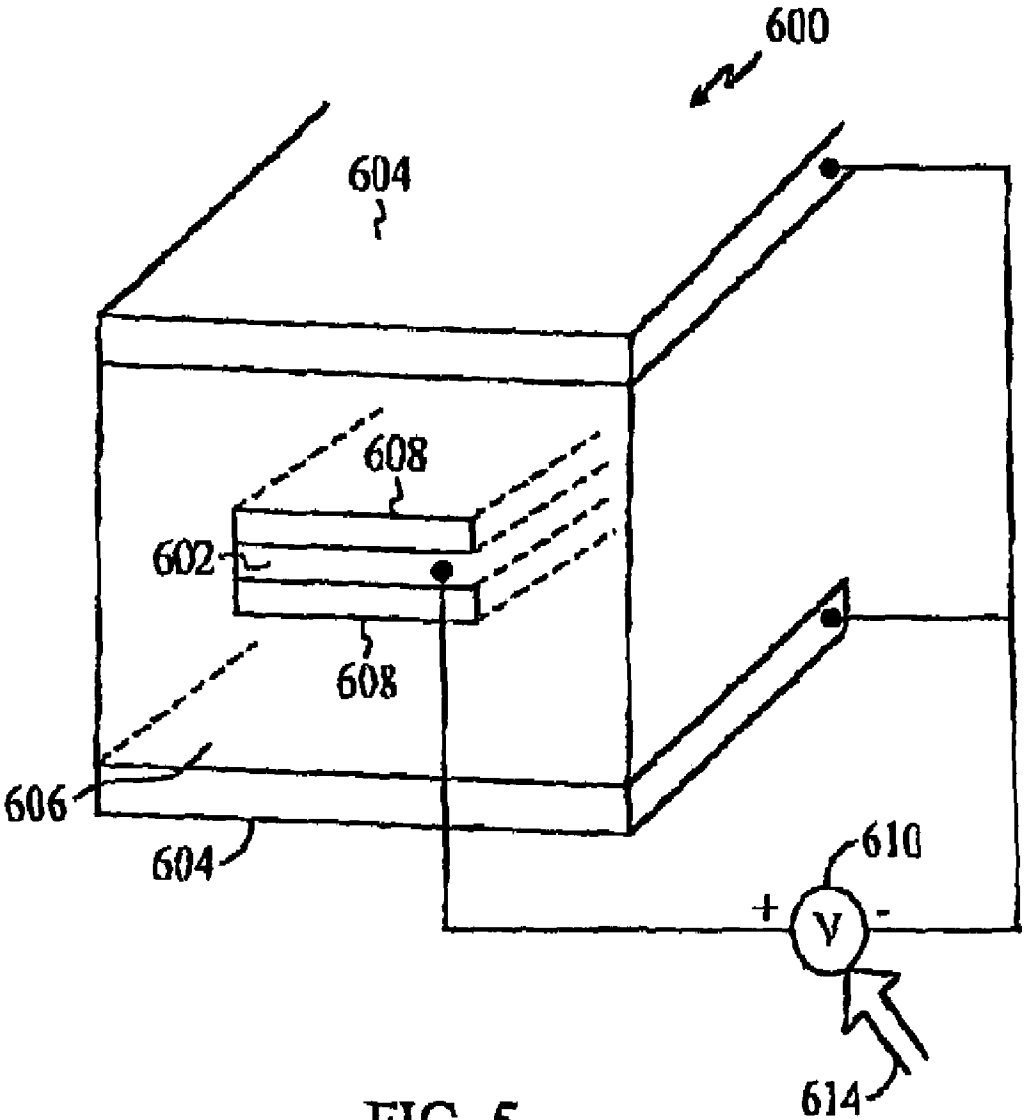
FIG. 5 is a diagram of a second example of a stripline resonator utilizing the f-e film.

FIG. 5 shows a second example of a stripline resonator 600 comprised of a central conductor 602, two grounded outer conductors 604, and a dielectric substrate 606. The f-e film 608 is mounted between the central conductor 602 and the dielectric substrate 606. A dc voltage source 610 controlled by control signal 614 is applied between the central conductor 602 and the two outer conductors 604 so as to generate an E-field within the f-e film and thereby dynamically adjust the resonant frequency of the resonator 600. With no external load, a stripline resonator can provide a Q of about 750 within the PCS band with an I.L. of about 2.2 dB at a 3 dB bandwidth of 6 MHz.

Filter tuning with f-e films can also be implemented according to a similar scheme as that described for tuning with varactors where tuning is accomplished by adjusting the effective electrical length of one end of the resonator. Instead of mounting the f-e film within the coax, stripline, or microstrip resonators as shown in FIGS. 2, 3 and 5, the film is coupled to the transmission medium by mounting it as an overlay capacitor as illustrated for the overlay capacitor coupled resonator 700 shown in FIG. 6. The basic resonator 701, which can be coaxial, stripline or microstrip, is mounted atop a ceramic substrate 706 with an underlying rf ground plane 704. An f-e film layer 708 of thickness d is positioned towards one end of the resonator and sandwiched between the resonator's grounded outer layer and an overlaid metal layer 722, thereby forming the overlay capacitor. Coupling to such a resonator can be achieved by either electromagnetic coupling, capacitive coupling, or by a direct tap into and out of the resonator (or filter) structure. F-e thin film layers of about 1 micro-meter seem to provide high dc R fields for a given (small) dc voltage. For an inductively coupled input signal, both ends of the resonators inner conductor 702 can be grounded as shown. A dc voltage source 710 controlled by control signal 714 generates the E-field used to adjust the capacitance of the overlay capacitor.

Direct f-2 thin film deposition can be done on some substrates, or with buffer layers on others. The packaging of an f-3 device may eliminate the need for a substrate.

Figure 1:
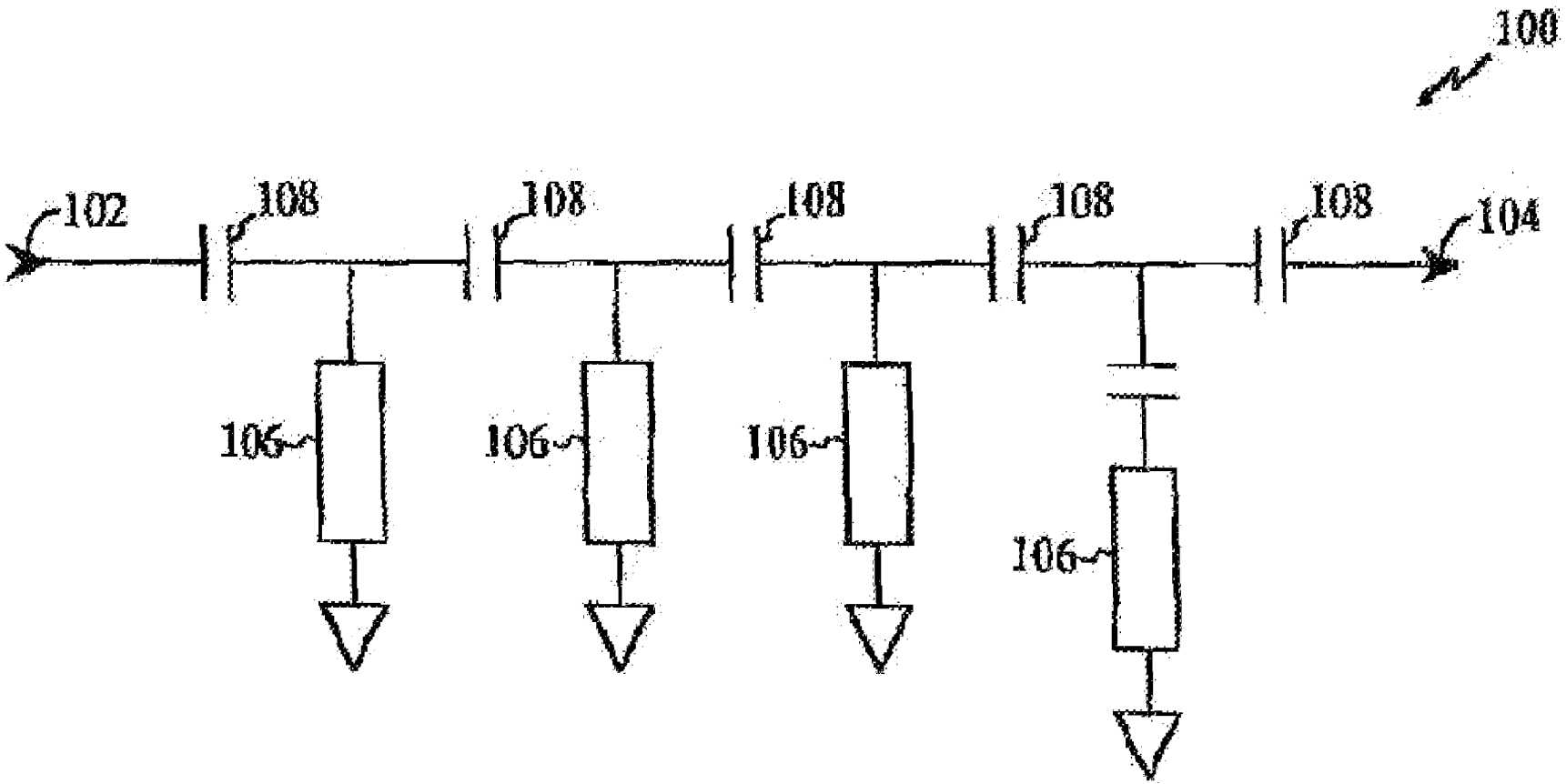
FIG. 1 PRIOR ART
FIG. 1 shows a typical implementation of a bandpass filter utilizing multiple coupled resonators.
Figure 7:
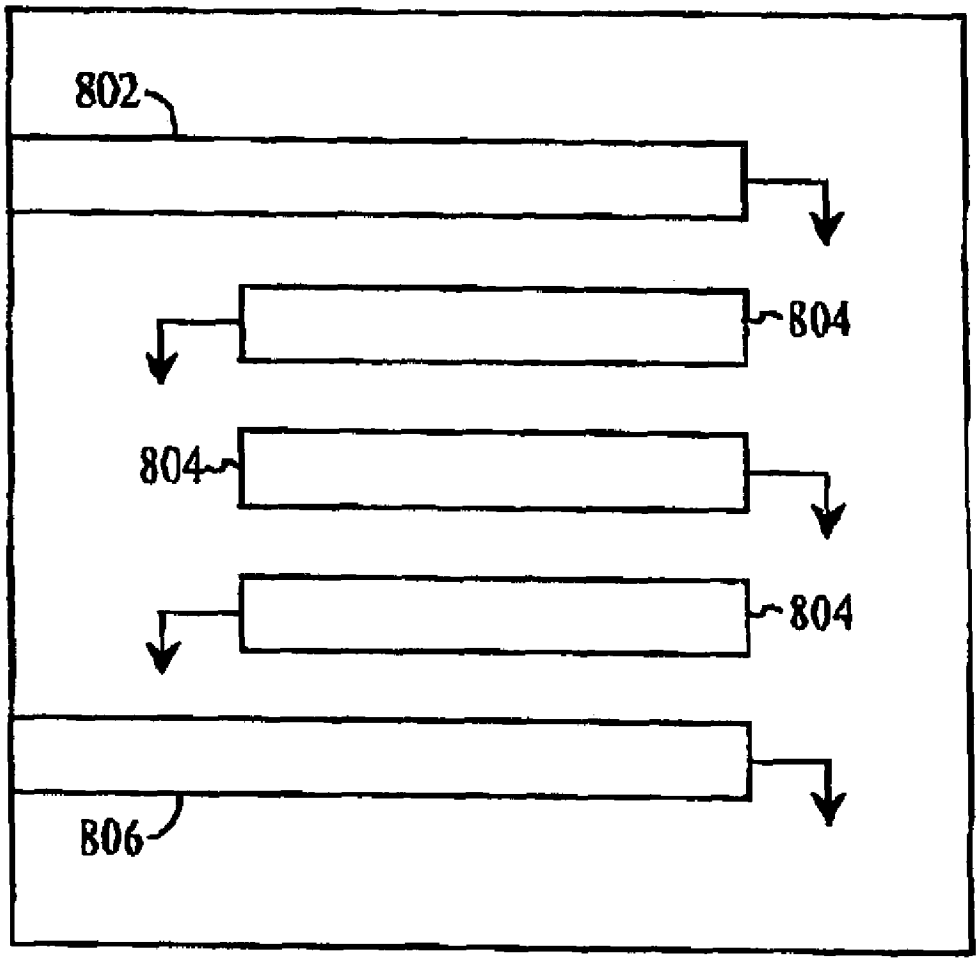
FIG. 7 is a diagram of an interdigitated filter topology.

As shown in FIG. 1, multiple resonators can be electrically coupled to obtain a higher order filter with a filter transfer function that, while centered about the same resonant frequency as that of the resonator, has a more abrupt cutoff and a flatter peak than each individual resonator's transfer function. A number of different filter topologies utilizing different resonator types are possible. Popular topologies utilizing stripline and microstrip resonators include interdigitated filters, combline filters, and edge coupled and hairpin filters. FIG. 7 is the top view of an example of an interdigitated filter topology utilizing f-e film electrical tuning in which the wavelength-frequency relationship within the resonator is varied. The input signal via transmission line 802 is electromagnetically coupled to each resonator in turn as it travels across the resonators (vertically in the figure), and is output via transmission line 806. Each resonator has one capacitively loaded and one shorted end. The relative placement of which is alternated for adjacent filter. The resonance frequency of the resonator is electrically adjusted as described above for f-e film electrical tuning utilizing the wavelength-frequency relationship adjustment.

Figure 8:
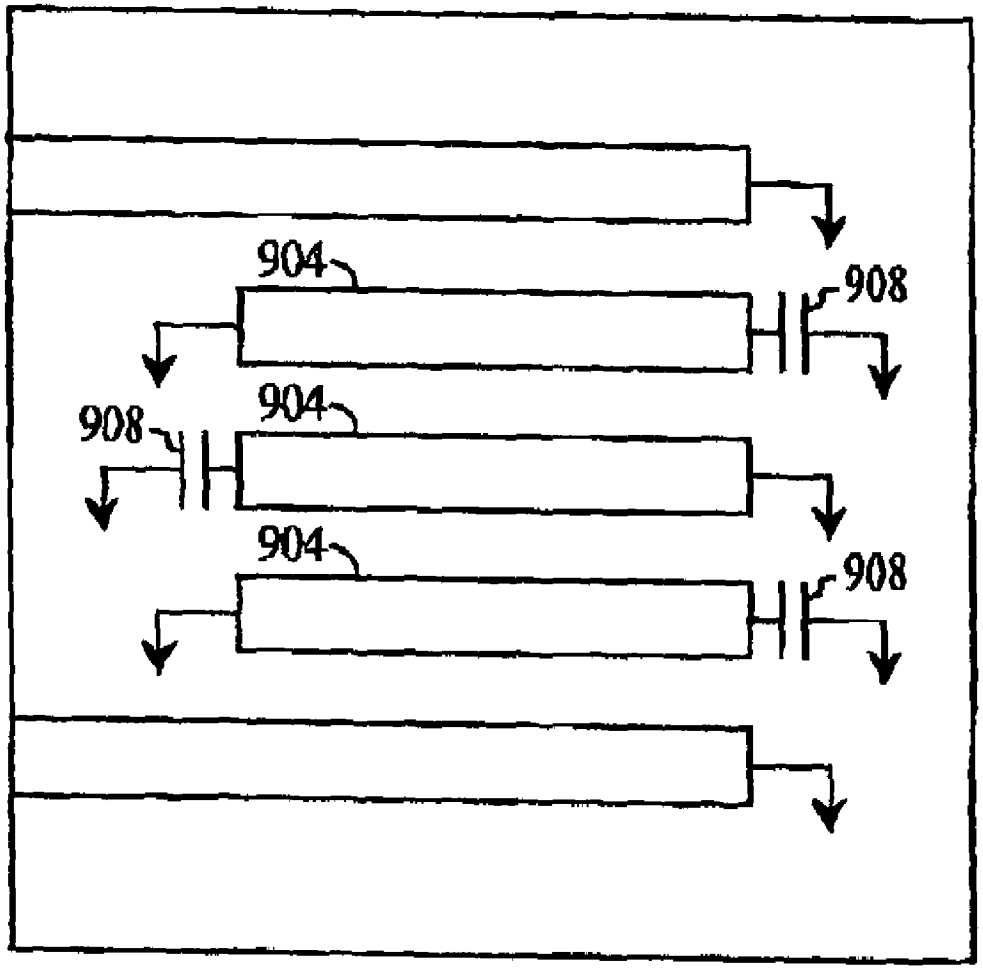
FIG. 8 is a diagram of an interdigitated filter topology utilizing overlay capacitors.

FIG. 8 shows the same topology as that of FIG. 7 but with tuning achieved via the use of overlay capacitors 908 coupled to what would otherwise have been the open end of the resonators 904.

Figure 9:
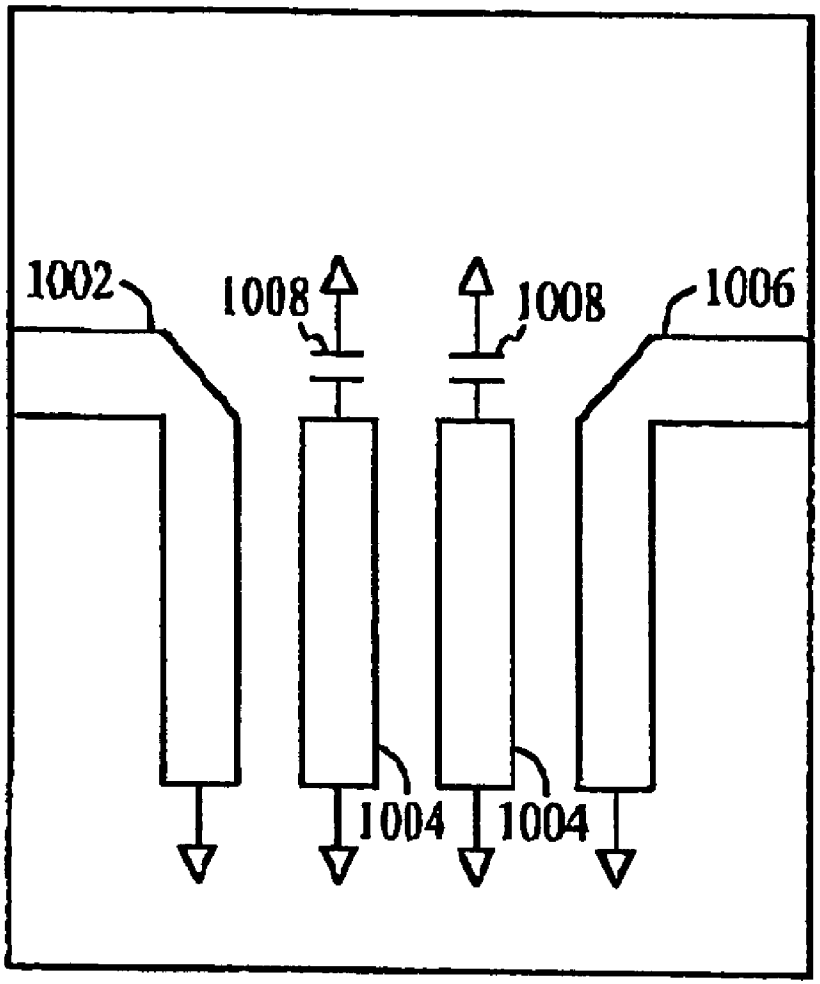
FIG. 9 is a diagram of a combline filter topology utilizing overlay capacitors.

FIG. 9 is the top view of an example of a second order electromagnetically coupled planar combline filter topology utilizing overlay capacitors 1008. The signal input via transmission line 1002 is electromagnetically coupled to each resonator in turn as it travels across the resonators 1004 (horizontally in the figure), and is outputted via transmission line 1006. Such a filter may have a 10 mhz bandwidth in the PCS band. With a 20 mil thick MgO substrate, no buffer layer may be needed.

Figure 6:
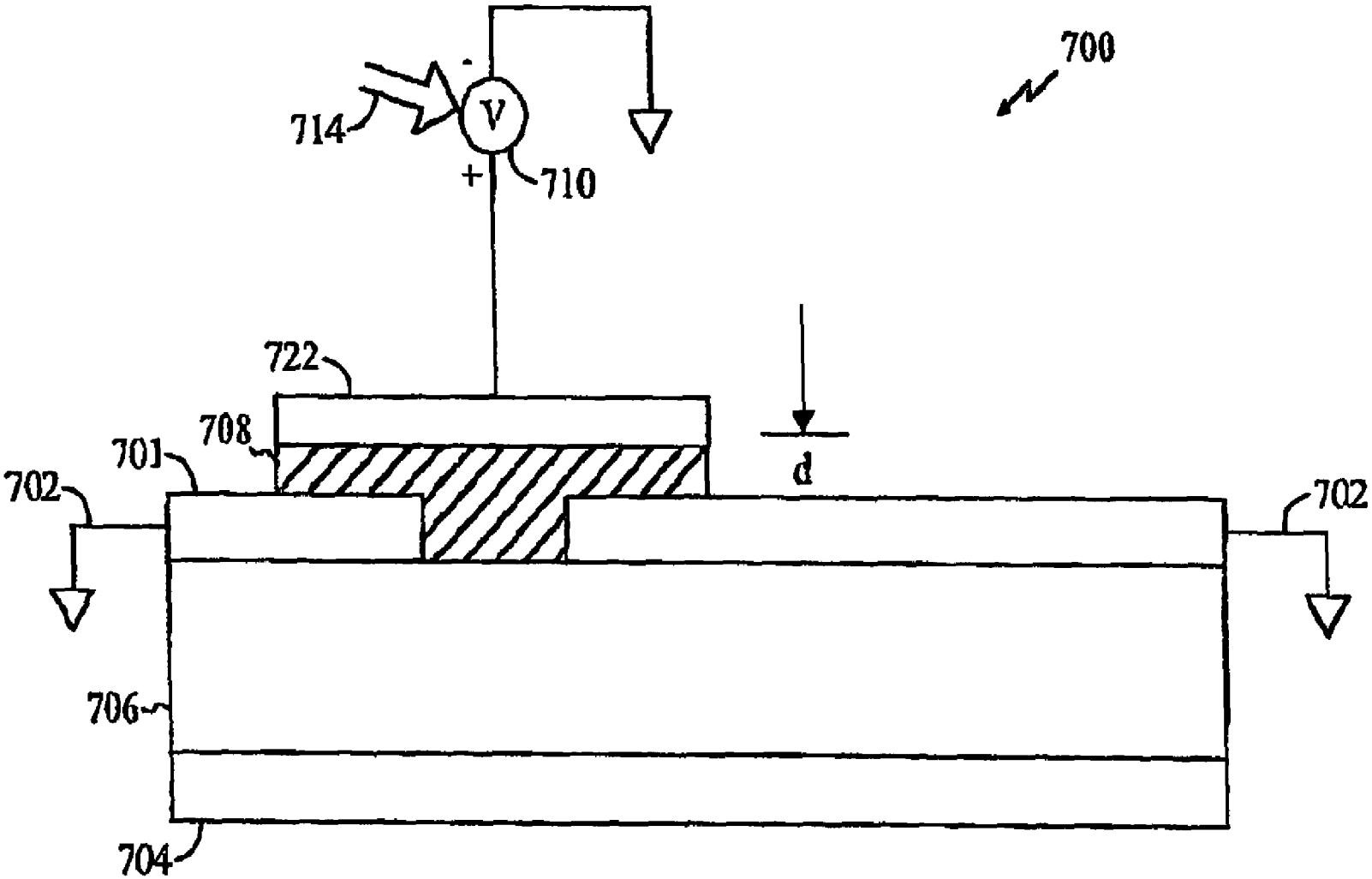
FIG. 6 is a diagram of an overlay capacitor coupled resonator utilizing the f-e film.

The structure of the resonators is not limited to that shown in FIGS. 2–6. Any resonator structure where an f-e film is coupled to the transmission medium is contemplated by the invention. For instance, instead of being mounted within the resonator as shown in FIG. 5, the f-e film could be mounted on one or more outside surface of the coaxial or stripline resonator similarly to the arrangement shown in FIG. 4 for the DLWG resonator. Likewise, the f-e layers need not be limited to coupling apertures of the DLWG shown in FIG. 4. Instead, f-e film can be deposited on the I/O (Input/Output) surfaces on the waveguide as well as on one or more surfaces on the outside. Additionally, instead of using just one overlay capacitor as shown in FIG. 6, two or more overlay capacitors can be used at either or both ends of the resonator. FIG. 10 is a table generally illustrating some of the design options, benefits and issues associated with a variety of f-e device designs. Designs 3, 4, and 5 generally range from minimum insertion loss, maximum size to minimum size maximum insertion loss.

It can thus be appreciated that the objectives of the present invention have been fully and effectively accomplished. The foregoing specific embodiments have been provided to illustrate the structural and functional principles of the present invention and is not intended to be limiting. To the contrary, the present invention is intended to encompass all modifications, alterations, and substitutions within the spirit and scope of the appended claims.

What is claimed is:

1. A tunable bandpass filter comprising:

a resonator having a reactance with a resonant frequency;

a first electrical tuning circuit electrically coupled to the resonator and adapted to change the resonant frequency of the resonator by changing an electrical length of the resonator, wherein the first electrical tuning circuit further comprises:

a capacitor having capacitance and adapted to change the electrical length of the resonator by changing the capacitance of the capacitor in response to an electric field, wherein the capacitor further comprises:

a first portion of the resonator adapted to form a first plate of a first capacitor;

a first portion of a ferroelectric film electrically coupled to the first portion of the resonator and having a dielectric constant with a value, related to the capacitance of the capacitor, adapted to change in response to an electric field; and a first portion of an electrically conductive element adapted to form a second plate of the first capacitor, electrically coupled to the first portion of the ferroelectric film, and disposed opposite to the first portion of the resonator.

2. A tunable bandpass filter, according to claim 1, wherein the capacitor further comprises:

a second portion of the resonator electrically isolated from the first portion of the resonator and adapted to form a first plate of a second capacitor;

a second portion of the ferroelectric film electrically coupled to the second portion of the resonator and having the dielectric constant with the value, related to the capacitance of the capacitor, adapted to change in response to the electric field; and a second portion of the electrically conductive element adapted to form a second plate of the second capacitor, electrically coupled to the second portion of the ferroelectric film, and disposed opposite to the second portion of the resonator.

3. A tunable bandpass filter, according to claim 2, wherein the first and second portions of the resonator are electrically coupled to a ground potential.

4. A tunable bandpass filter, according to claim 1, further comprising:

a voltage source electrically coupled to the capacitor and adapted to provide a voltage that generates the electric field.

5. A tunable bandpass filter, according to claim 4, further comprising:

a control signal electrically coupled to the voltage source and adapted to control the voltage to generate the electric field being relatively constant and having different strengths within the ferroelectric film.

6. A tunable bandpass filter, according to claim 1, wherein the resonator includes at least a first end and a second end, and wherein the first electrical tuning circuit is electrically coupled to the first end of the resonator.

7. A tunable bandpass filter, according to claim 6, wherein a second electrical tuning circuit, having the same construction and operation as the first electrical tuning circuit, is electrically coupled to the second end of the resonator.

8. A tunable bandpass filter, according to claim 1, wherein the resonator further comprises one of the following types of resonators:

a coaxial resonator, a dielectric loaded waveguide resonator, a stripline resonator, and a microstrip resonator.

9. A tunable bandpass filter, according to claim 8, wherein the stripline resonator and the microstrip resonator each further comprise one of the following types of topologies:

interdigitated topology, combline topology, edge coupled topology, and hairpin topology.

10. A tunable bandpass filter, according to claim 8, wherein the microstrip resonator further comprises:

a microstrip filament being electrically conductive;

a ground plane being electrically conductive; and a dielectric substrate disposed between an inner surface of the microstrip filament and the ground plane.

11. A tunable bandpass filter, according to claim 10, wherein the ferroelectric film is disposed between an outer surface of the microstrip filament and the first portion of an electrically conductive element.

12. A tunable bandpass filter comprising:

a resonator having a reactance with a resonant frequency;

a first electrical tuning circuit electrically coupled to the resonator and adapted to change the resonant frequency of the resonator by changing an electrical length of the resonator, wherein the first electrical tuning circuit further comprises:

a capacitor having capacitance and adapted to change the electrical length of the resonator by changing the capacitance of the capacitor in response to an electric field, wherein the capacitor further comprises:

a first portion of the resonator adapted to form a first plate of a first capacitor;

a first portion of a ferroelectric film electrically coupled to the first portion of the resonator and having a dielectric constant with a value, related to the capacitance of the capacitor, adapted to change in response to an electric field;

a first portion of an electrically conductive element adapted to form a second plate of the first capacitor, electrically coupled to the first portion of the ferroelectric film, and disposed opposite to the first portion of the resonator;

a second portion of the resonator electrically isolated from the first portion of the resonator and adapted to form a first plate of a second capacitor;

a second portion of the ferroelectric film electrically coupled to the second portion of the resonator and having the dielectric constant with the value, related to the capacitance of the capacitor, adapted to change in response to the electric field; and a second portion of the electrically conductive element adapted to form a second plate of the second capacitor, electrically coupled to the second portion of the ferroelectric film, and disposed opposite to the second portion of the resonator;

a voltage source electrically coupled to the capacitor and adapted to provide a voltage that generates the electric field; and a control signal electrically coupled to the voltage source and adapted to control the voltage to generate the electric field being relatively constant and having different strengths within the ferroelectric film.

13. A tunable bandpass filter, according to claim 12, wherein the first and second portions of the resonator are electrically coupled to a ground potential, and wherein the first and second portions of the electrically conductive element are electrically coupled to a positive voltage potential of the voltage source.

14. A tunable bandpass filter, according to claim 12, wherein the resonator includes at least a first end and a second end, and wherein the first electrical tuning circuit is electrically coupled to the first end of the resonator.

15. A tunable bandpass filter, according to claim 14, wherein a second electrical tuning circuit, having the same construction and operation as the first electrical tuning circuit, is electrically coupled to the second end of the resonator.

16. A tunable bandpass filter, according to claim 12, wherein the resonator further comprises one of the following types of resonators:

a coaxial resonator, a dielectric loaded waveguide resonator, a stripline resonator, and a microstrip resonator.

17. A tunable bandpass filter, according to claim 16, wherein the stripline resonator and the microstrip resonator each further comprise one of the following types of topologies:

interdigitated topology, combline topology, edge coupled topology, and hairpin topology.

18. A tunable bandpass filter, according to claim 16, wherein the microstrip resonator further comprises:

a microstrip filament being electrically conductive and including the first and the second portions of the resonator;

a ground plane being electrically conductive; and a dielectric substrate disposed between an inner surface of the microstrip filament and the ground plane.

19. A tunable bandpass filter, according to claim 18, wherein the ferroelectric film is disposed between an outer surface of the microstrip filament and the first and the second portions of an electrically conductive element.

20. A monolithic tunable bandpass filter comprising:

a microstrip resonator, having a reactance with a resonant frequency, including:

an ground plane being electrically conductive;

a dielectric substrate disposed on the ground plane;

a microstrip filament being electrically conductive and disposed on the dielectric substrate;

a first electrical tuning circuit electrically coupled to the microstrip resonator and adapted to change the resonant frequency of the microstrip resonator by changing an electrical length of the microstrip resonator, wherein the first electrical tuning circuit further comprises:

a capacitor having capacitance and adapted to change the electrical length of the microstrip resonator by changing the capacitance of the capacitor in response to an electric field, wherein the capacitor further comprises:

a first portion of the microstrip filament adapted to form a first plate of a first capacitor;

a first portion of a ferroelectric film electrically coupled to and disposed on the first portion of the microstrip filament, and having a dielectric constant with a value, related to the capacitance of the capacitor, adapted to change in response to an electric field;

a first portion of an electrically conductive element adapted to form a second plate of the first capacitor, electrically coupled to and disposed on the first portion of the ferroelectric film, and disposed opposite to the first portion of the microstrip filament;

a second portion of the microstrip filament electrically isolated from the first portion of the microstrip filament and adapted to form a first plate of a second capacitor;

a second portion of the ferroelectric film electrically coupled to the second portion of the microstrip filament and having the dielectric constant with the value, related to the capacitance of the capacitor, adapted to change in response to the electric field; and a second portion of the electrically conductive element adapted to form a second plate of the second capacitor, electrically coupled to the second portion of the ferroelectric film, and disposed opposite to the second portion of the microstrip filament;

a voltage source electrically coupled to the capacitor and adapted to provide a voltage that generates the electric field; and a control signal electrically coupled to the voltage source and adapted to control the voltage to generate the electric field being relatively constant and having different strengths within the first and the second portions of the ferroelectric film.

wherein the first and the second portions of the microstrip filament are electrically coupled to a ground potential, and wherein the first and second portions of the electrically conductive element are electrically coupled to a positive voltage potential of the voltage source.

21. A monolithic tunable bandpass filter, according to claim 20, wherein the microstrip resonator includes at least a first end and a second end, and wherein the first electrical tuning circuit is electrically coupled to the first end of the microstrip resonator.

22. A monolithic tunable bandpass filter, according to claim 21, wherein a second electrical tuning circuit, having the same construction and operation as the first electrical tuning circuit, is electrically coupled to the second end of the microstrip resonator.

23. A monolithic tunable bandpass filter, according to claim 20, wherein the microstrip resonator further comprises one of the following types of topologies:

interdigitated topology, combline topology, edge coupled topology, and hairpin topology.

* * * * *